US006715632B2

(12) United States Patent
Baker

(10) Patent No.: US 6,715,632 B2
(45) Date of Patent: Apr. 6, 2004

(54) LOCKABLE TRAY CONTAINER

(75) Inventor: Everette G. Baker, Bedford (CA)

(73) Assignee: Plastiques M&R Inc., Quebec (CA)

( * ) Notice: Subject to any disclaimer, the term of this patent is extended or adjusted under 35 U.S.C. 154(b) by 0 days.

(21) Appl. No.: 09/788,160

(22) Filed: Feb. 16, 2001

(65) Prior Publication Data

US 2002/0113074 A1 Aug. 22, 2002

(51) Int. Cl.[7] ..... B65D 43/16; B65D 43/22
(52) U.S. Cl. ..... 220/835; 220/839; 220/4.23
(58) Field of Search ..... 220/4.23, 4.24, 220/835, 839, 324, 326

(56) References Cited

U.S. PATENT DOCUMENTS 2,687,157 A * 8/1954 Cowan ..... 220/4.23
3,536,251 A * 10/1970 Edwards
3,737,067 A * 6/1973 Palson ..... 220/324
3,767,110 A * 10/1973 Congleton ..... 220/4.23
4,005,800 A * 2/1977 Schurman ..... 220/835
4,079,880 A * 3/1978 Edwards ..... 220/4.23
4,684,024 A * 8/1987 Ebrahim et al. ..... 220/324
4,917,261 A * 4/1990 Borst ..... 220/324
4,986,438 A * 1/1991 Borst ..... 220/324
5,695,087 A * 12/1997 Tutton et al. ..... 220/324
5,906,292 A * 5/1999 Rider, Jr. ..... 220/839

* cited by examiner

*Primary Examiner*—Nathan J. Newhouse
(74) *Attorney, Agent, or Firm*—Tracey D. Beiriger

(57) ABSTRACT

A container has two tray sections that fold over each other along a living hinge. Each of the trays is defined by a recessed domes that is contained within the hinge and lip surfaces opposite and on either side of the hinge. A contoured flap containing a cavity extends from a forward edge of the front of one of the tray lips. A step is provided in the other tray's lip. When the container is closed, the flap may be folded over the step where a recess in the flap engages a detent in the step. A lip extends about the flap cavity and provides a continues tab around the step parts of which facilitate a consumer flipping the flap out of engagement with the step thereby facilitate opening of a closed container.

8 Claims, 2 Drawing Sheets

LOCKABLE TRAY CONTAINER

BACKGROUND OF THE INVENTION

The present invention relates to containers and, in particular, to containers formed in one-piece, having two tray parts and a lock mechanism for securing the trays to one another.

Such containers, often formed of BOPS (biaxially oriented polystyrene) are commonly used in supermarkets and other food stores to package salads, muffins, prepared foods and the like. It is desirable that once the container is closed, the trays may be locked to one another to secure the food or other product contained therein to prevent spillage. In the prior art, this was commonly done by providing on one of the trays a series of projections or buttons adapted to seat into recesses in the other tray both of which were contained on a lip extending from the edge of each tray section. This required some alignment of the buttons and recesses to close the container and then relied on the frictional fit between the buttons and recesses for the locking action. Once closed, such containers are sometimes not easily opened, resulting in jarring and sometimes spilling of the container contents. Such containers pose particular problems for the elderly and those with physical disabilities.

SUMMARY OF THE INVENTION

In view of the above, it is the principal object of the present invention to provide an improved container having a simplified lock arrangement that is easy to engage, positively holds the container parts together and is relatively easy to disengage and thus making it senior friendly. A further object is to provide such a lock arrangement which may be formed integrally with the container trays and which does not interfere with the filling or emptying of the container.

A further object is to provide a lock arrangement that will engage on a more consistent basis and require less precise dimensions for the locking members to function satisfactorily.

A still further object is to provide a container which can accept a label over the lock requiring removal of the label (thereby presenting evidence of tampering) before the lock can be opened.

The above and other objects and advantages are attained in accordance with the present invention by providing a container having two tray sections that fold over each other along a living hinge. Each of the trays is defined by a recessed dome that is contained within the hinge and lips on the surfaces opposite to and on either side of the hinge. A contoured flap containing a cavity extends from a forward edge of one of the tray lips preferably the front lip. A step is provided in the opposite tray's lip. When the container is closed, the flap may be folded over the step where a recess in the flap formed by its cavity engages a detent in the step. A lip extends about the flap cavity which is slightly longer than the step and extends beyond the step. The flap lip provides a continuous tab around the step, parts of which facilitate a consumer flipping the flap out of engagement with the step thereby facilitate opening of a closed container.

DETAILED DESCRIPTION OF THE PREFERRED EMBODIMENT

Figure 1:
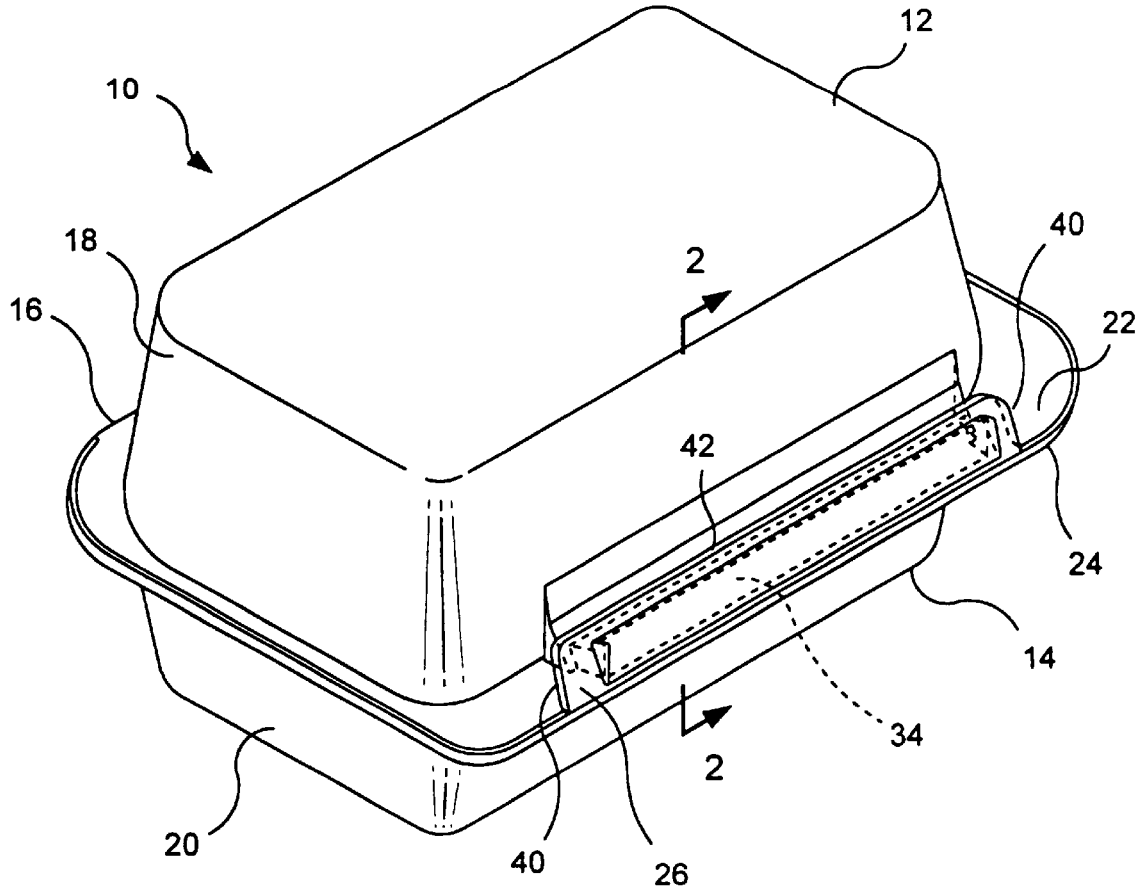
FIG. 1 is a perspective view of a container in accordance with the present invention.

Reference is now made to the drawings and to FIG. 1 in particular wherein a container 10 in accordance with the present invention is depicted. The container 10 consists of an upper tray 12 and lower tray 14. The trays 12, 14 are joined to one another, clam-shell style, by a living hinge 16 that extends along the rear of the assembled container. The container may be thermo-formed of any suitable material such as biaxially oriented polystyrene (BOPS) or P.E.T. which is commonly used for packaging food products. Each of the trays 12, 14 has a main body portion 18, 20 in the form of a recessed dome that may be rectangular, semi-circular, oval or the like. The domes may be plain or contoured to the shape of muffins, eggs or the like. In the assembled container, the domes 18, 20 form the top and bottom trays, respectively.

Figure 3:
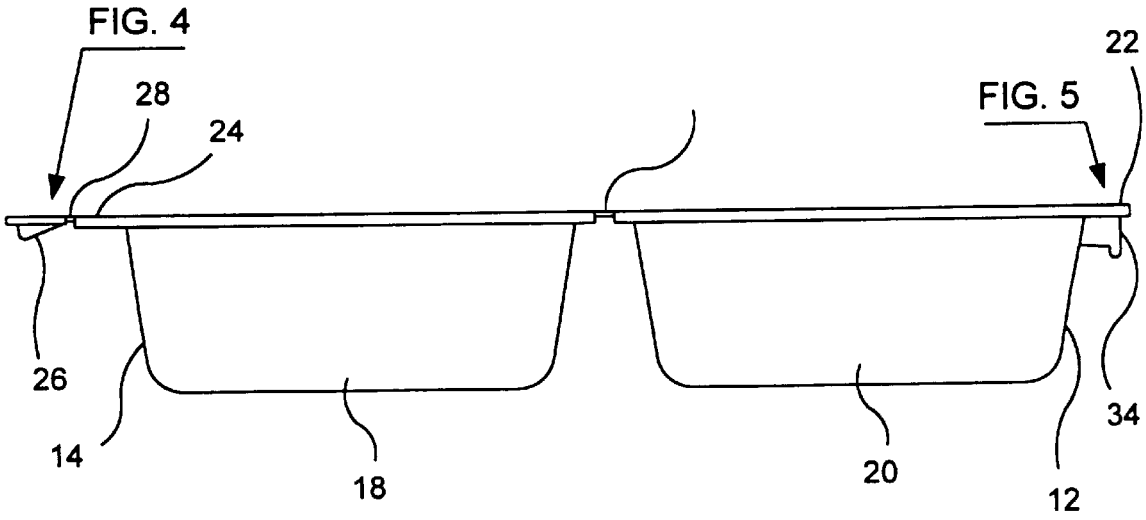
FIG. 3 is a side elevational view of the container fully opened.
Figure 2:
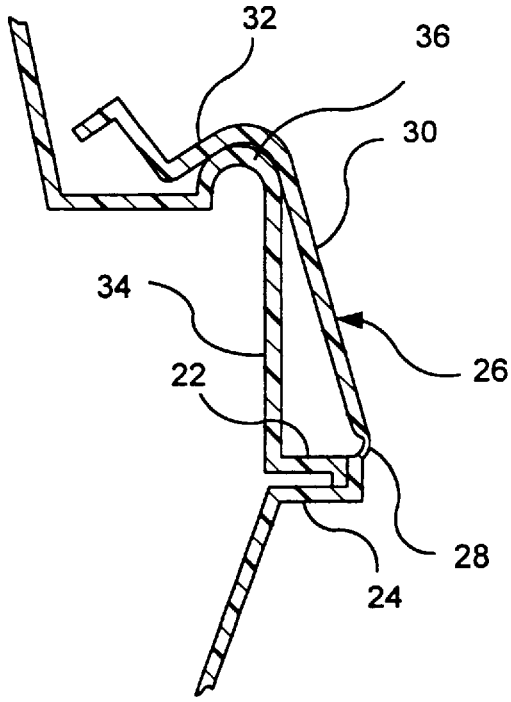
FIG. 2 is an enlarged fragmentary sectional view taken along reference lines 2—2 in the direction indicated by the arrows.
Figure 4:
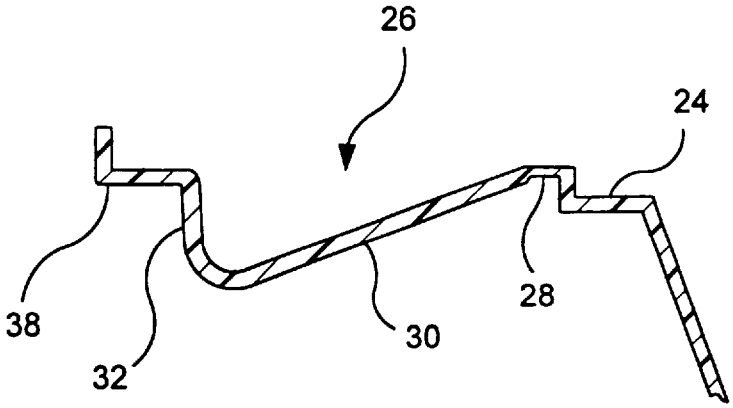
FIG. 4 is a fragmentary enlarged sectional view of the flap portion of one of the trays in said open position.
Figure 5:
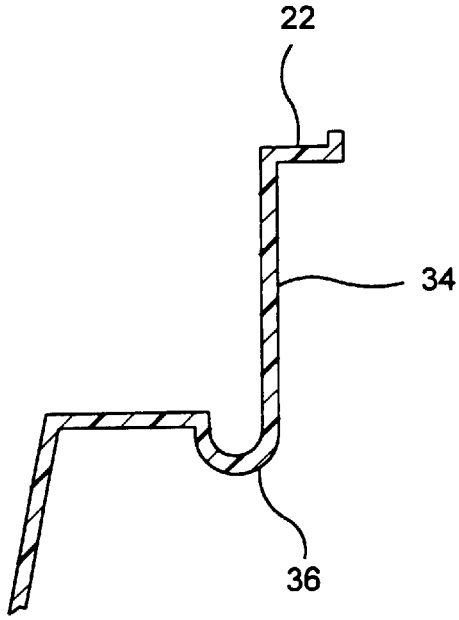
FIG. 5 is a fragmentary enlarged sectional view of the step portion of the other of the trays in said position.

Both of the domes 18, 20 depend from lips 22, 24 that extend about the dome periphery. Accordingly, the living hinge 16 joins the lips 22, 24 at the rear of the container and thus forms the mid-line of the unfolded container depicted in FIG. 3. In accordance with the present invention, a flap 26 extends from the free front edge of lip 24. The flap is centered along the front of lip 24 and is connected to the lip edge by living hinge 28. As shown in FIG. 4, the flap consists of a cavity portion 30 that terminates in an upturned edge 32. A step 34 is formed on the front lip 22 of tray 18. The step 34 has an extension of the step rise forming a detent 36 at its forward edge. The width of flap 26 and height of step 34 are such that when the container is closed and the flap is folded over the step, the detent 36 snaps into position in the recess formed by the junction of the cavity portion 30 and up-turned edge 32. A flap lip 38 extends entirely about the free edges of flap 26. The side edges 40 of lip 38 extend beyond step 34 and the front edge 42 of flap lip 38 extends above the step. These edges of the flap lip may conveniently be flipped by a consumer to thereby disengage the flap from the step to disengage the lock and permit the container to be easily opened.

Having thus described the invention, what is claimed is:

1. A container comprising:

a first tray and a second tray, said trays being joined to one another by a hinge extending along rear edges of said trays;

a first tray lip extending from said first tray and a second tray lip extending from said second tray;

a flap hingedly connected to an edge of said first tray lip;

a step disposed on a portion of said second tray lip opposite said first tray lip, said step and said flap having portions contoured to inter-engage, said inter-engaging and contoured portions further comprising a substantially arcuate shaped detent, in cross section, associated with said second tray lip, and a likewise substantially arcuate shaped recess with ends on ether edge associated with said first tray lip; and wherein, when said second tray is folded over said first tray, said first and second tray lips are adjacent to each other and said flap may be folded over said step to thereby inter-engage said recess over said detent so that said detent and said ends surround said recess.

2. The container in accordance with claim 1 wherein said detent comprises an extension of the step use and the recess is formed at the junction of said flap and an upturned wall of said flap.

3. The container in accordance with claim 1 wherein said hinge connecting said first tray and said second tray is a living hinge.

4. The container in accordance with claim 1 wherein said hinge connecting said first tray lip and said flap is a living hinge.

5. The container in accordance with claim 1 further comprising a lip extending about said flap, said flap lip extending beyond said step detent when said contoured portions engage.

6. The container in accordance with claim 1 wherein said first tray lip and said second tray lip are at the front of the container.

7. The container in accordance with claim 1 wherein said first tray lip extends about said first tray.

8. The container in accordance with claim 7 wherein said second tray lip extends about said second tray.

* * * * *

UNITED STATES PATENT AND TRADEMARK OFFICE

CERTIFICATE OF CORRECTION

PATENT NO. : 6,715,632 B2
DATED : April 6, 2004
INVENTOR(S) : Everette G. Baker

It is certified that error appears in the above-identified patent and that said Letters Patent is hereby corrected as shown below:

Column 3,
Line 7, insert -- rise -- delete "use".

Signed and Sealed this

Twenty-fifth Day of October, 2005

JON W. DUDAS
*Director of the United States Patent and Trademark Office*